US006604297B2

(12) United States Patent
Hagemann et al.

(10) Patent No.: US 6,604,297 B2
(45) Date of Patent: Aug. 12, 2003

(54) DEVICE FOR FRESHENING FABRICS

(75) Inventors: Uwe Hagemann, Merseyside (GB); Steven Hayes, Merseyside (GB); Raymond Honey, Merseyside (GB); Colin Watt Kerr, Merseyside (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/983,051

(22) Filed: Oct. 17, 2001

(65) Prior Publication Data

US 2002/0050073 A1 May 2, 2002

(30) Foreign Application Priority Data

Oct. 18, 2000 (GB) ..... 0025555

(51) Int. Cl.[7] ..... F26B 7/00
(52) U.S. Cl. ..... 34/380; 34/331; 34/60
(58) Field of Search ..... 34/60, 318, 321, 34/331, 332, 389, 443, 63, 90, 380

(56) References Cited

U.S. PATENT DOCUMENTS

| | | | | | |
|---|---|---|---|---|---|
| 2,846,776 | A | * | 8/1958 | Clark | 34/45 |
| 3,267,701 | A | * | 8/1966 | Mandarino | 34/60 |
| 3,435,537 | A | | 4/1969 | Rumsey, Jr. | 34/72 |
| 3,634,947 | A | | 1/1972 | Furgal | 34/60 |
| 3,701,202 | A | * | 10/1972 | Compa et al. | 34/72 |
| 3,736,668 | A | * | 6/1973 | Dillarstone | 34/60 |
| 4,004,685 | A | * | 1/1977 | Mizuno et al. | 206/5 |
| 4,014,105 | A | * | 3/1977 | Furgal et al. | 34/12 |
| 4,014,432 | A | | 3/1977 | Clothier et al. | 206/5 |
| 4,053,992 | A | * | 10/1977 | Furgal | 34/60 |
| 4,532,719 | A | * | 8/1985 | Davies et al. | 34/12 |
| 4,532,722 | A | * | 8/1985 | Sax | 34/60 |
| 4,567,675 | A | * | 2/1986 | Rennie | 34/60 |
| 5,020,240 | A | | 6/1991 | Lee | 34/60 |
| 5,072,526 | A | | 12/1991 | Hirota et al. | 34/60 |
| 5,966,831 | A | | 10/1999 | Anderson | 34/60 |

FOREIGN PATENT DOCUMENTS

| | | |
|---|---|---|
| CA | 1 005 204 | 2/1977 |
| EP | 361 593 | 4/1994 |
| GB | 1 399 728 | 7/1975 |
| GB | 2 066 309 | 12/1980 |
| WO | 01/07703 | 2/2001 |
| WO | 01/07704 B | 2/2001 |

OTHER PUBLICATIONS

PCT International Search Report in a PCT application PCT/EP 01/11784.
GB Search Report in a GB application GB 0025555.4.
PCT International Search Report in a PCT application PCT/EP 01/11785.

* cited by examiner

*Primary Examiner*—Ira S. Lazarus
*Assistant Examiner*—K. B. Rinehart
(74) *Attorney, Agent, or Firm*—Kevin J. Stein

(57) ABSTRACT

The invention provides a device for freshening fabrics in a tumble dryer during multiple tumble drying cycles. The device comprises: a reservoir for storing a fabric freshening composition, holes or opening in the reservoir to expose fabric freshening composition from the reservoir to airflow generated inside the tumble drier thereby transferring a portion of the fabric freshening component into contact the fabric freshening composition and transfer a portion thereof into contact with fabrics in the tumble dryer during a tumble drying cycle; suction, adhesive, hook, or claw fastener for attaching the device to the inside of the tumble dryer door; and optionally the contents of the reservoir are visible to the user for indicating to a user when the fabric freshening composition is used up.

2 Claims, 10 Drawing Sheets

23
24
26
28
29

24
25
27
30
26

28
29

27

42
40
39

48
41
45
43
44

49
50

40
41

49

DEVICE FOR FRESHENING FABRICS

The present invention relates to a device for freshening fabrics inside a tumble dryer, in particular a device which is reusable and attaches to the inside of the tumble dryer door.

In the treatment of fabrics in a tumble dryer it is known to add one or more conditioning agents. For instance, for imparting a softening benefit to fabrics it is known from CA 1,005,204 to co-mingle fabrics in a tumble dryer with a flexible substrate carrying a normally solid fabric conditioning agent. In co-mingling fabrics with impregnated substrates, however, there is a risk that the conditioner may not be evenly distributed. Furthermore, the co-mingling of the fabrics with impregnated substrates requires the separation of the substrate from the fabrics after the completion of the tumble dryer treatment. Especially in using flexible substrates, this separation is often time-consuming in that the substrates cannot readily be located. Other disadvantages of such products include uneven product distribution following entanglement of the substrate with fabrics and the tendency of such substrates to "post" over the tumble dryer vent, thus giving virtually no benefit to the fabrics during a tumble drying cycle. Furthermore, these products are designed for single use only and therefore need to be replaced after every cycle.

For overcoming these problems it has been suggested, for instance in GB 2,066,309 and U.S. Pat. No. 3,634,947, to use conditioner dispensing articles, comprising means for attachment of the substrate to the tumble dryer wall. Other proposals, such as for instance disclosed in GB 1,399,728 involve the use of separate means for attaching the conditioning article to the tumble dryer wall.

EP-B-361593 concerns an alternative approach in which a fabric conditioning article comprises a combination of a substrate and a fabric conditioning composition, the substrate being a porous material with a specified void volume and cell count. The article of EP-B-361593 is designed to adhere to the tumble dryer wall.

It is an object of the present invention to provide an improved article suitable for freshening fabrics in a tumble dryer.

According to the present invention, there is provided a device for freshening fabrics in a tumble dryer during multiple tumble drying cycles comprising: a reservoir for storing a fabric freshening composition having at least a perfume component, means to expose fabric freshening composition from the reservoir to airflow generated inside the tumble drier thereby transferring a portion of the fabric freshening component into contact with fabrics in the tumble dryer during a tumble drying cycle and means for attaching the device to the inside of the tumble dryer door.

Optionally the fabric freshening composition may also provide conditioning and/or other benefits to the fabrics inside the tumble dryer during a tumble drying cycle.

The device of the present invention has a number of advantages over prior art devices. It is easier for a user to affix a device to the inside of the tumble dryer door, which swings open to face the user during loading and unloading of the tumble dryer, than it is to affix a device inside the tumble dryer drum as is the case with prior art devices. Once affixed to the inside of the tumble dryer door the device of the invention is clearly visible to the user during loading and unloading of the tumble dryer. The device of the invention preferably comprises means for indicating to the user when the fabric freshening composition is used up, thus enabling the user to determine when the fabric freshening composition or the device itself needs replacing. Attachment of the device to the tumble dryer door makes it easier to replace or refill the device when the fabric freshening composition is used up than is the case with prior art devices attached to the tumble dryer drum.

The device according to the invention may comprise a reservoir which is designed to be replaced when the fabric freshening composition is used up. For example, the reservoir may be provided in the form of a disposable plastic pot or carton with a peelable lid.

Alternatively, the reservoir may be designed to be recharged with a new fabric freshening composition when required. In this case the reservoir has an openable portion for charging and, if necessary, discharging the fabric freshening composition. For example, the reservoir may be provided in the form of an openable compartment into which may be placed a block or semi-permeable sachet of fabric freshening composition. Suitable materials for the reservoir include polypropylene.

The fabric freshening composition may be in the form of a liquid, solid or gel. The composition essentially comprises a perfume and may also comprise one or more perfume solubilisers.

Suitable perfume solubilisers include surfactants, particularly nonionic surfactants such as alcohol ethoxylates, but also anionic, cationic, zwitterionic or amphoteric surfactants which may be used either alone or in combination with each other or with nonionic surfactants.

Other suitable perfume solubilisers include semi-polar solvents such as dipropylene glycol, butyl digol, polyethylene glycol, propylene glycol monobutyl ether and combinations thereof.

However, it is also possible to use a soluble perfume in the fabric freshening composition, in which case it may not be necessary to use a perfume solubiliser.

Optional ingredients in the fabric freshening composition (which may provide conditioning or other benefits) include:

Antistatic Agents:

- e.g. surfactants, particularly cationic, phosphate esters, silicones, polymers Garment Care Agents:

- Softening agents e.g. cationic, Quaternary salts, particularly Di long chain ester quats, nonionics, fatty acids, alcohols and amines, clays.
- Shape retention e.g. thermoplastic elastomers, (e.g. PMMA—polymethylmethacrylic acid), cationic, quaternary salts, polymers, cross-linked polymers.

Easy Iron Agents:

- Anti wrinkle agents e.g. silicones, polyolefin dispersions, starch, hydrophilic polymers, cross-linked polymers
- Iron glide agents e.g. silicones, ester oils, hydrocarbons, lubricants Improved Cleaning Performance Agents:

- Anti redeposition agents e.g. SCMC (sodium carboxymethylcellulose), PVP (polyvinyl pyrrolidone, PET/POET (polyethylene terephthalate/polyoxyethylene terephthalate (e.g. Aquaperle)
- Soil/stain agents release e.g. Cellulose ethers, SCMC, Fluorocarbons
- Fluorescers e.g. Tinopal DMS-X- Tinopal CBS-X Colour Care Agents:

- Reduced fibrilation agents e.g. quaternary salts, cationic polymers, cellulosic polymers enzymes (e.g. cellulose type)
- Anti Dye transfer agents e.g. PVP, PVI (polyvinyl imidazoline), PVP-NO (polyvinyl pyridine-N-oxide Dye fixers e.g. amino functional polymers, polymeric quats, metal ions Anti ash agents e.g. polyacrilates, sequestrants (e.g. EDTA (Ethylene diamine tetra-acetic acid), EDDS (ethylene diamine disuccinic acid), EHDP (ethane 1-hydroxy,1,1-diphosphonic acid))

UV absorbants e.g. Parsol MCX, Uvinul, Tinuvin 871

Sequestrants e.g. heavy metals sequestrants (e.g. Copper), Dequest 2047, EDDS

Chlorine scavengers e.g. ammonium salts, thisulfate

Hygiene Agents:

Antibacterials/antifungals e.g. Triclosan, Diclosan, TCC (trichlorocarbanilide)

Antioxidants e.g. BHT (butylated hydroxytoluene), Vitamin C, Vitamin E

Odour Neutralization e.g. cyclodextrins, deo perfumes, activated charcoal, bicarbonate, zeolites, vermiculites Machine Care Agents:

Corrosion inhibitors e.g. silicates, BTA (Benzotriazole), lubricants

Skin Care Agents:

Moisturising/Humectants ingredients e.g. silicones, ester oils, glycerol, polyols, urea, cationic polymers Ancillary ingredients:

Preservatives e.g. Kathon, BIT (1,2-benzisothiazolin-3-one), Miacide, Benzyl Alcohol, Phenoxyetol, Parabens, Glydant Thickening polymers/agents e.g. Polyacrilates, Carbomer, Cellulose ethers, CMC (carboxymethyl cellulose), Xantham Gum, Guar Gums, electrolytes Hydrotropes e.g. ethanol, IPA (isopropyl alcohol), Propilene Glycol DPG (dipropylene glycol), Glycerol, SXS (sodium xylene sulphonate), SCS (sodium cumen (isopropylbenzene)sulphonate), urea Solvents e.g. alcohols, Polyols, hydrocarbons, ethers, esters The means to expose the fabric freshening composition may simply comprise one or more openings in the reservoir e.g. a single opening, for example in the case were the reservoir is provided in the form of a disposable plastic cup with a peelable lid having a solid fabric freshening composition situated therein. In this case the reservoir is attached to the inside of the tumble dryer door and the lid peeled off to expose the solid fabric freshening composition therein. It may be desirable in this case to provide some form of restraining means, for example in the form of a grid or mesh over the fabric freshening composition to prevent the solid product falling out of the reservoir in use.

Alternatively, the reservoir may have a number of openings through which the fabric freshening composition can be viewed. For example, the reservoir may be constructed in the form of a cage with multiple slotted apertures in at least one surface of reservoir to allow airflow into and out of the reservoir. In this case the reservoir may be designed to be re-used on a number of occasions and has an openable and reclosable portion through which the fabric freshening composition can be charged and discharged to the reservoir.

In further embodiments of the invention, the at least one opening in the reservoir may comprise a multiplicity of very small openings, as in the case where a portion of the reservoir is provided with a semi-permeable membrane through which the fabric composition can migrate to contact air flowing against the external surface of the membrane. Suitable semi-permeable materials include Goretex™ and Accurel™. Other semi-permeable materials include open cell foams, pumice, sintered materials etc. Alternatively, a wall of the reservoir may comprise a series of capillary holes.

The transfer of fabric freshening composition to the fabrics in the tumble drier may be effected solely by airflow generated in the tumble drier. Depending upon the model of the tumble drier and program setting temperatures of up to 100° C. with wet clothes may be generated within the tumble drier, generally in the range 40 to 80° C. for most drying cycles (the hot air generated by the heater in the tumble drier may be as high as 150° C., generally 110 to 120° C.). In addition, the means to expose the fabric freshening composition may be constricted and arranged such that there may be direct contact between fabric in the tumble drier and the exposed fabric freshening composition in order to facilitate transfer of fabric freshening composition to the fabric.

In an alternative embodiment of the invention the wall of the reservoir is provided with at least one opening which is substantially closed by a retained rotatable sphere whereby fabric freshening composition from the reservoir contacts the surface of the sphere which may rotate to expose fabric freshening composition to warm air generated inside the tumble drier. The retained sphere acts in an analogous manner to a ball point pen or roller-ball deodorant dispenser. Rotation of the sphere within the tumble drier may take place by the vibration of the machine and/or contact with the tumbling garments.

The reservoir of the device of the invention preferably holds sufficient fabric freshening composition for a plurality of drying cycles of the tumble drier. Preferably the reservoir holds sufficient composition for at least six, preferably at least ten drying cycles, more preferably at least twenty cycles, of the tumble drier. The device may comprise means for dispensing a unit dose of fabric composition from the reservoir at or before the start of the drying cycle which is sufficient to provide the required amount of fabric freshening composition during the drying cycle. The reservoir may be divided into a plurality of cavities or compartments each containing fabric composition, the contents of each cavity may be sequentially transferred to the means to expose the fabric composition or may simply be sequentially exposed to the warm air in the tumble drier e.g. by removing a lid.

In a further embodiment of the invention the device comprises means for urging fabric composition inside the reservoir towards the means to expose the fabric freshening composition. The means to urge the composition preferably comprises a pump which may dispense fabric freshening composition from the reservoir to a sponge or a separate compartment having a membrane, slot or capillary holes through which the fabric freshening composition may pass thereby becoming exposed to hot air within the tumble drier. In such embodiments the user simply operates the pump, which may have a simple push action, to recharge the exposure means at the start of a drying cycle. If desired, a non-return valve may be disposed between the pump and the exposure means.

The means for attaching the device to the inside of the tumble dryer door may comprise adhesive means, for example in the form of an adhesive pad situated on one surface of the reservoir. Alternatively, suction means may be used in the form of, for example, a suction pad. Other suitable attachment means include hooks, claws and Velcro™. It may be desirable to provide more than one different type of attachment means on the device for versatility in different tumble dryer environments. For example a sucker form of attachment would be suitable for attaching the device to the glass door of a conventional tumble dryer with an external vent. However, many modern tumble dryers are self condensing and have a number of small holes in the inside of the door to allow moisture out of the tumble dryer drum to condense in a tray below. In this case, a hook or claw attachment on the device may be more suitable.

The means for indicating to the user when the fabric freshening composition is used up preferably comprises visible indicia associated with the device. In one embodiment of the invention, the user is able simply to inspect the quantity of fabric freshening composition remaining in the device by looking through the at least one opening of the reservoir to the composition therein. Alternatively, the fabric freshening composition maybe impregnated in a solid substrate which gives an appearance change, for example changes colour, when all the fabric freshening composition has been used up. In another embodiment of the invention, the reservoir may be formed from a transparent or translucent material to allow visual inspection of the quantity of fabric freshening composition inside the reservoir.

When the reservoir of the device is formed from flexible material, the device may further be provided with one or more resilient or sprung members mounted on the device and disposed to engage the reservoir in use and urge the contents of the reservoir towards the at least one opening therein.

The device of the invention may further comprise a flow controller to allow the user to regulate the quantity of fabric freshening composition contacted by the warm air in the tumble dryer during a tumble drying cycle.

In addition, according to the invention there is provided a method of freshening fabrics in a tumble dryer during multiple tumble drying cycles comprising attaching a device according to the invention to the inside of a tumble dryer door and carrying out a tumble drying process with fabrics inside the tumble dryer.

Further provided in accordance with the invention is a tumble dryer with a device according to the invention attached therein.

The invention will now be more particularly described with reference to the following figures in which.

Figure 1:
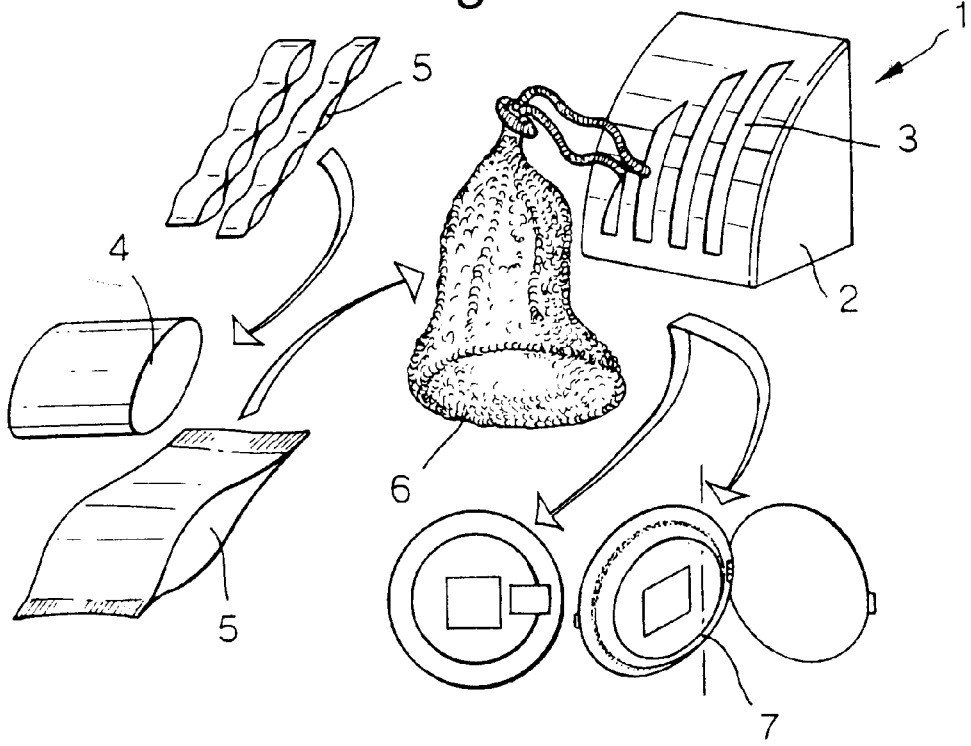
FIG. 1 is a schematic diagram of a first device according to the invention.

Referring to FIG. 1, there is provided a reservoir 1 of rigid plastic material comprising a wedge shaped container 2 with slotted apertures 3 in its curved surface to allow warm air into and out of the reservoir 1. The fabric freshening composition may be provided in the form of a solid block 4 or semi-permeable sachet(s) 5 of liquid material and placed inside the reservoir 1, optionally inside a net bag 6. The reservoir is then affixed to the inside of a tumble dryer door 7 as shown in FIG. 1.

Figure 2:
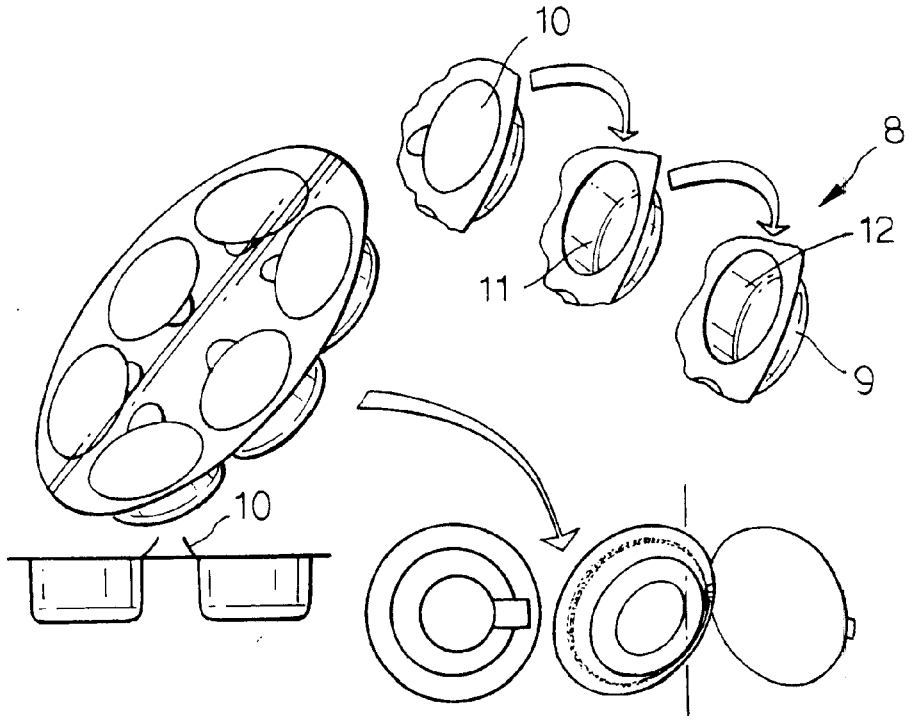
FIG. 2 is a schematic diagram of a second device according to the invention.

Referring to FIG. 2, the reservoir 8 is provided in the form of a rigid pot 9 having a peelable lid 10. The fabric freshening composition is a solid block 11 situated inside the pot and retained in place by restraining bars 12 across the main opening of the pot 9.

Figure 3:
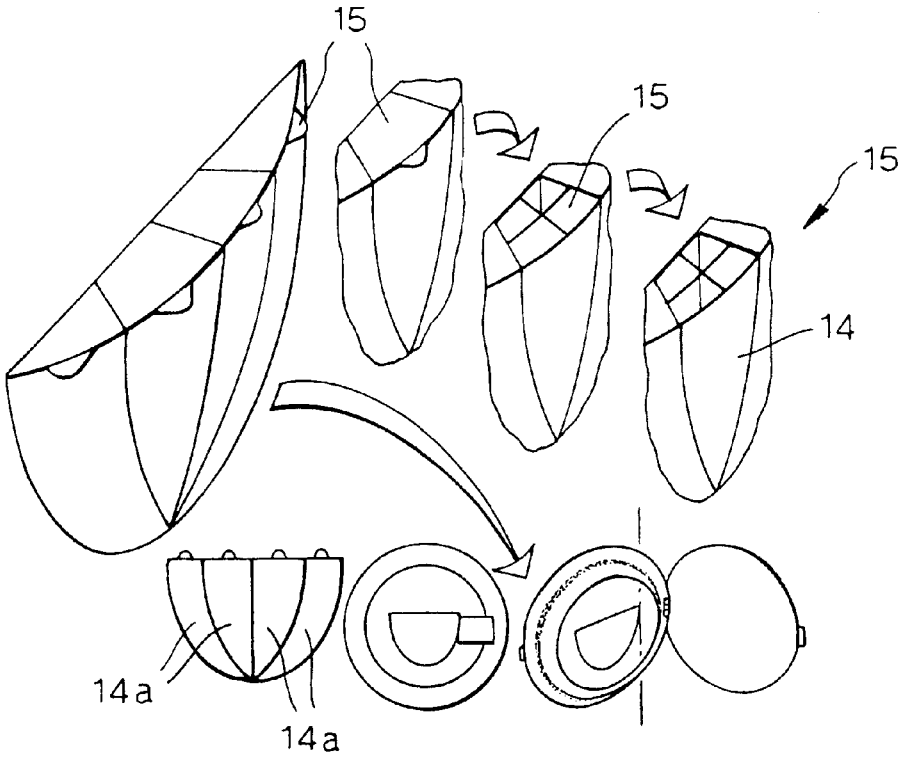
FIG. 3 is a schematic diagram of a third device according to the invention.

Referring to FIG. 3, the reservoir 13 is shown as a rigid plastic container 14 having a plurality of compartments 14*a* comprising a liquid fabric freshening composition 15. Each compartment has a peelable lid 15*a* which is removed to expose the composition 15.

Figure 4:
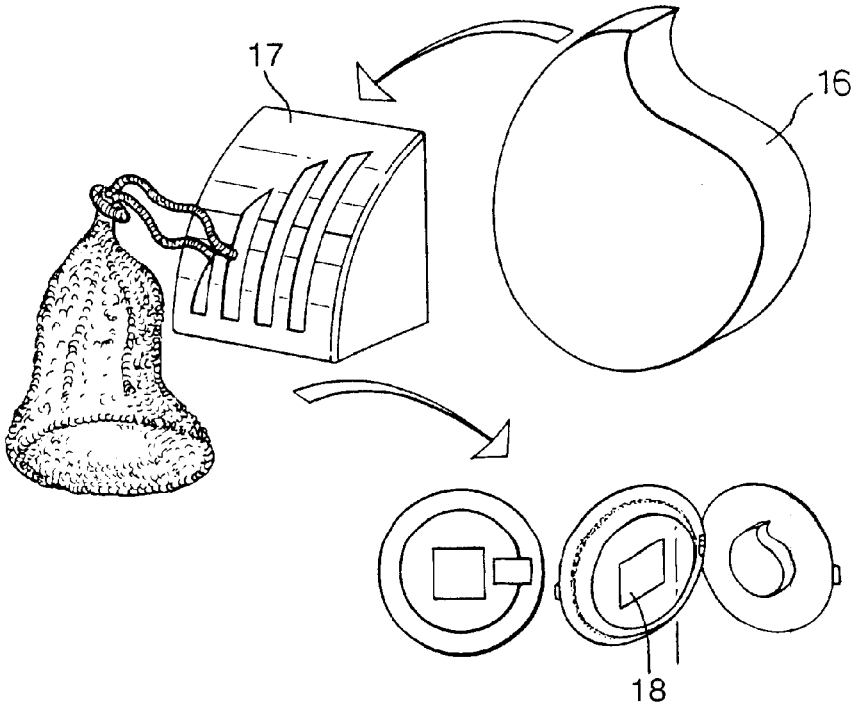
FIG. 4 is a schematic diagram of a fourth device according to the invention.

Referring to FIG. 4, the fabric freshening composition is dosed inside an absorbent sponge 16 which is placed inside the reservoir 17 prior to affixation to the tumble dryer door 18.

Figure 5:
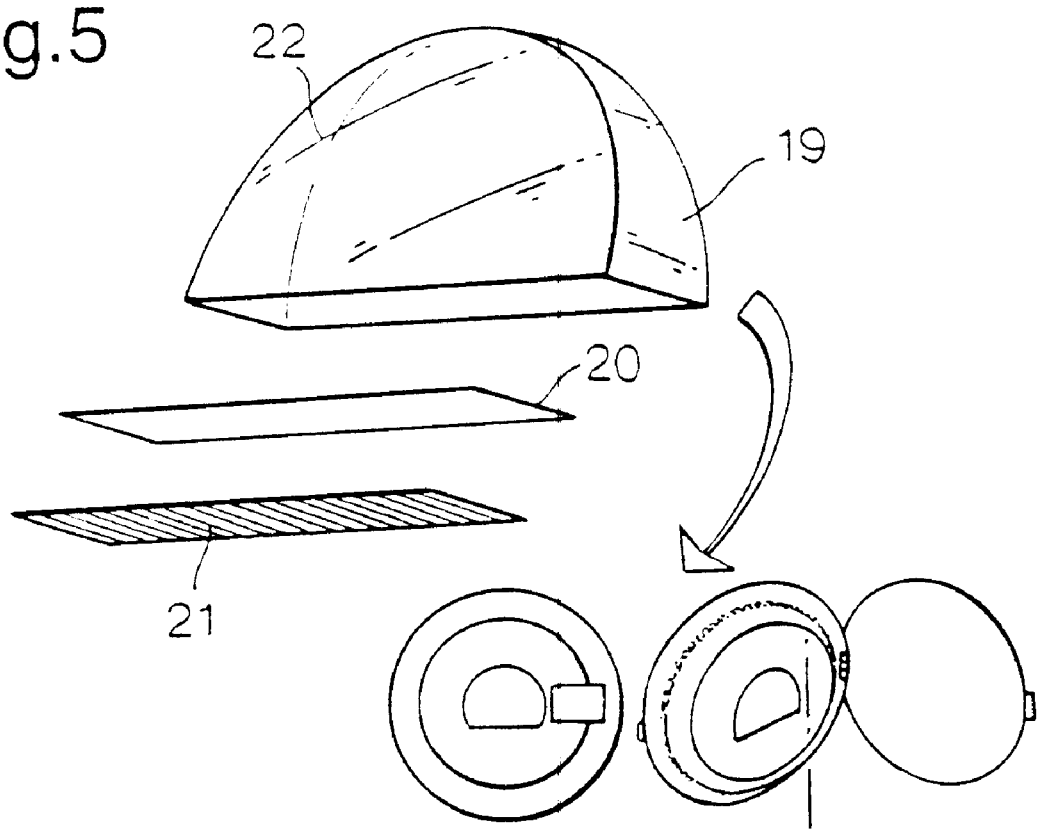
FIG. 5 is a schematic diagram of a fifth device according to the invention.

FIG. 5 shows a rigid reservoir 19 comprising a membrane base 20 and wick base 21 inside which a liquid fabric freshening composition 22 is located. In this case the reservoir 19 is formed from a transparent or translucent material to provide a visible indication to the user when the fabric freshening composition 22 is used up.

Figures 6A, 6B, 6C, 6D:
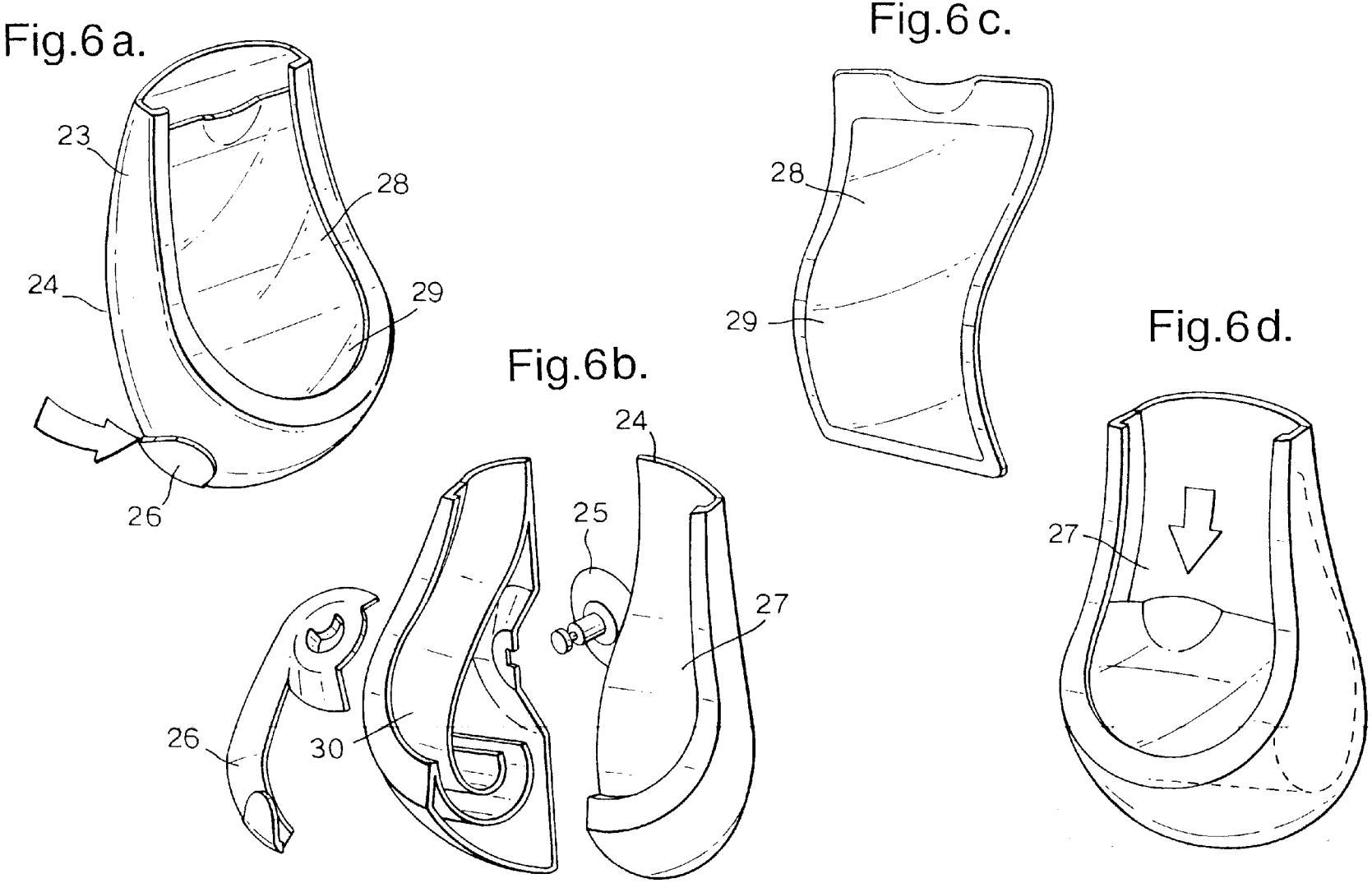
FIG. 6 is a schematic diagram of a sixth device according to the invention.

FIG. 6 shows a device 23 provided on its distal surface 24 with sucker attachment means 25 actuated by lever 26 mounted on the side of device 23. Device 23 comprises a compartment 27 for receiving a sachet 28 of fabric freshening composition. Sachet 28 has a semi permeable membrane portion 29 on one surface thereof. Sachet 28 slots into compartment 27 and the contents of the sachet are urged towards semi permeable membrane portion 29 by resilient member 30. Sachet 28 is of translucent material to provide visual indicia for determining when the fabric freshening composition is used up and needs replacing. The quantity of fabric freshening composition available for contact with airflow in the tumble dryer can be controlled by the user by adjusting the position of sachet 28 in compartment 27. Pushing flexible sachet 28 downwardly causes the sachet to wrap around the back of resilient member 30, thus removing any wrapped around portion of sachet 28 from contact with warm air in use.

Figures 7A, 7B, 7C, 7D:
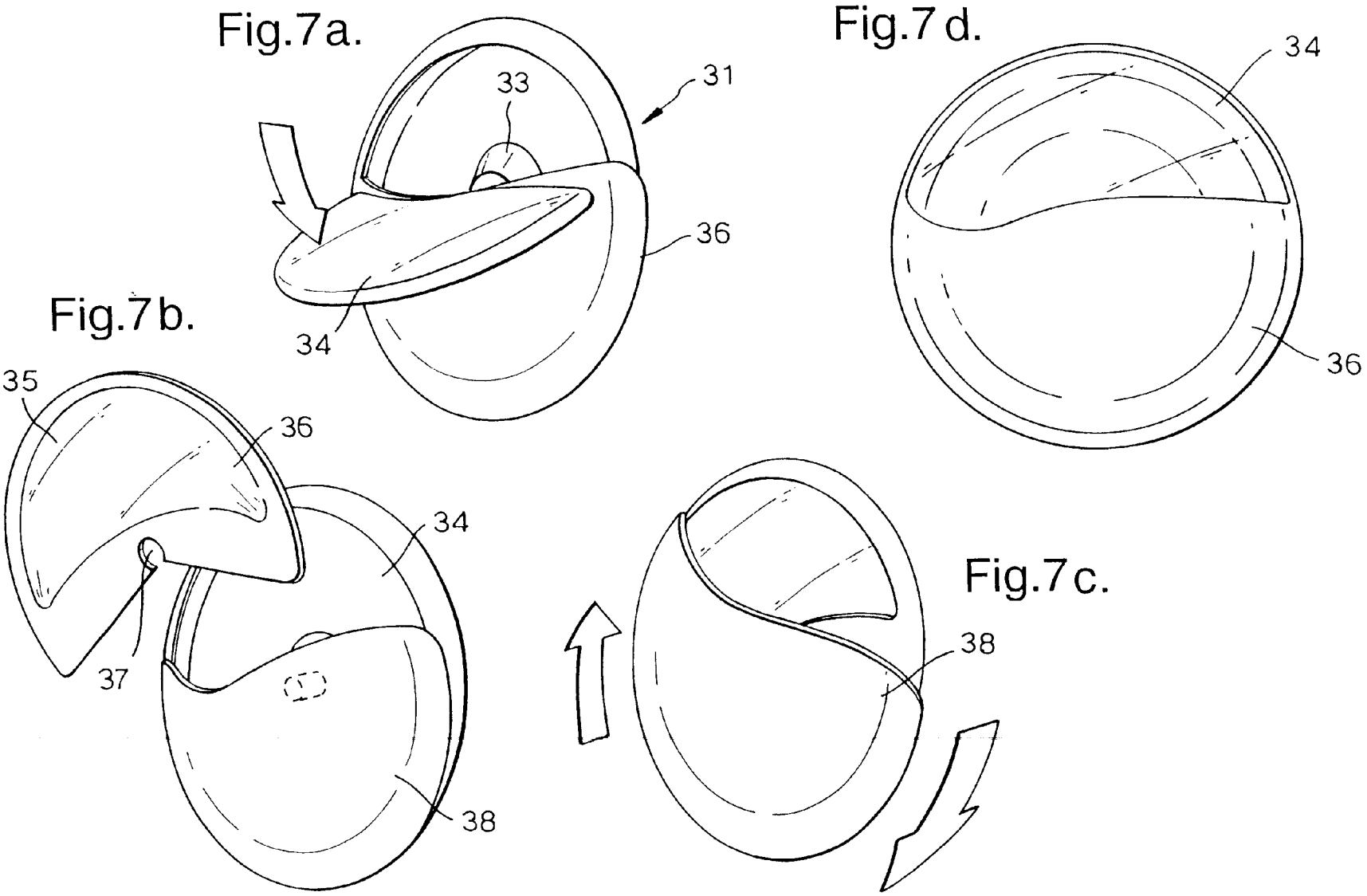
FIG. 7 is a schematic diagram of a seventh device according to the invention.

FIG. 7 shows a device 31 provided on its distal surface 32 with sucker attachment means 33 actuated by lever 34 mounted on the front of device 31. Device 31 comprises a compartment 34 for receiving a sachet 35 of fabric freshening composition. Sachet 35 has a semi-permeable membrane portion 36 on one surface thereof. Sachet 35 slots into compartment 34 and is retained in place by clip 37 which engages with the stem of sucker attachment means 33. Sachet 35 is of translucent material to provide visual indicia for determining when the fabric freshening composition is used up and needs replacing. The quantity of fabric freshening composition available for contact with airflow in the tumble dryer can be controlled by the user by adjusting the position of rotatable sleeve 38 to cover a selected portion of sachet 35 from contact with airflow in use.

Figures 8A, 8B, 8C, 8D, 8E:
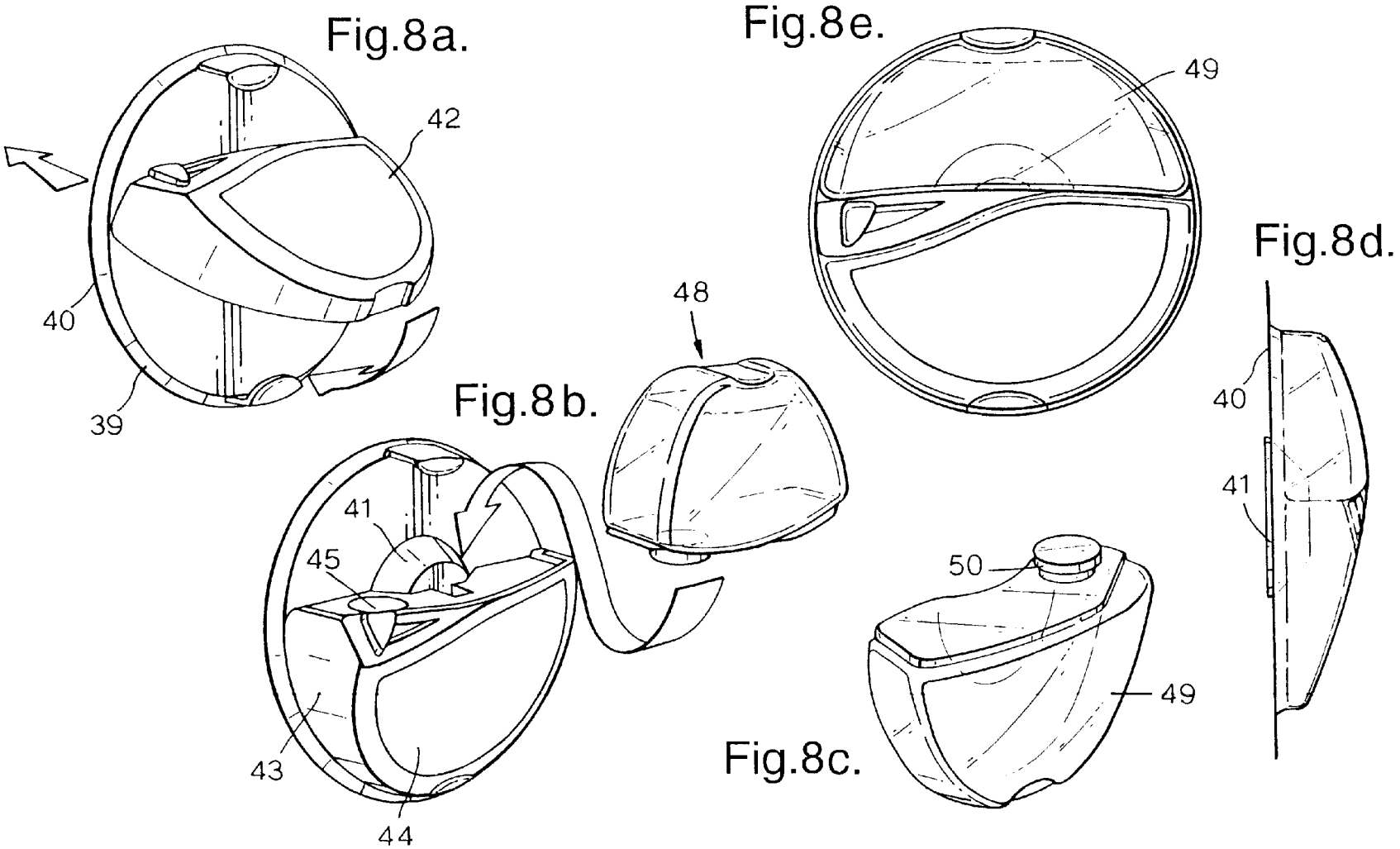
FIG. 8 is a schematic diagram of an eighth device according to the invention.

FIG. 8 shows a device 39 provided on its distal surface 40 with sucker attachment means 41 actuated by lever 42 mounted on the front of device 31. Device 39 comprises a reservoir 43 having two distinct portions. A first portion 44 comprises a hollow chamber inside lever 42 which has an inlet port 45 for a fabric freshening composition, a semi-permeable membrane portion 46 to allow fabric freshening composition inside reservoir portion 44 to migrate into contact with airflow in the tumble dryer and flow control means 47 for controlling the size of the aperture of inlet port 45. A second portion 48 comprises a translucent container 49 having an outlet port 50 engageable with inlet port 45 of first portion 44. Second portion 48 contains a liquid fabric freshening composition and is replaceable when the composition is exhausted.

Figure 9A:
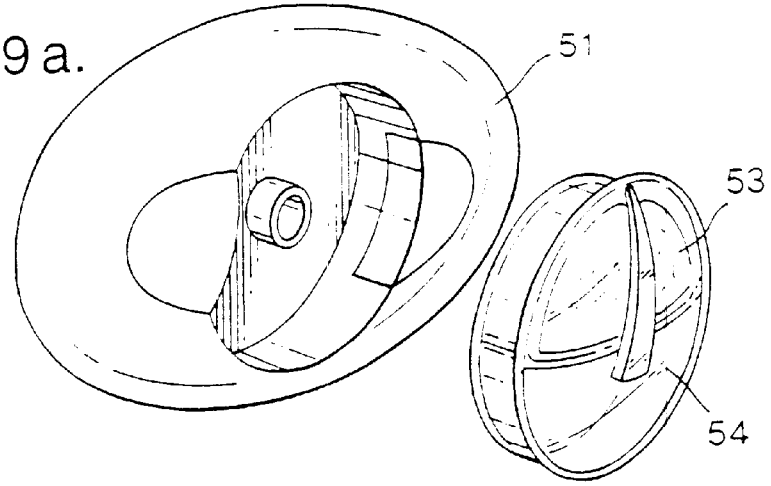
FIG. 9 is a schematic diagram of a ninth device according to the invention.
Figure 9B:
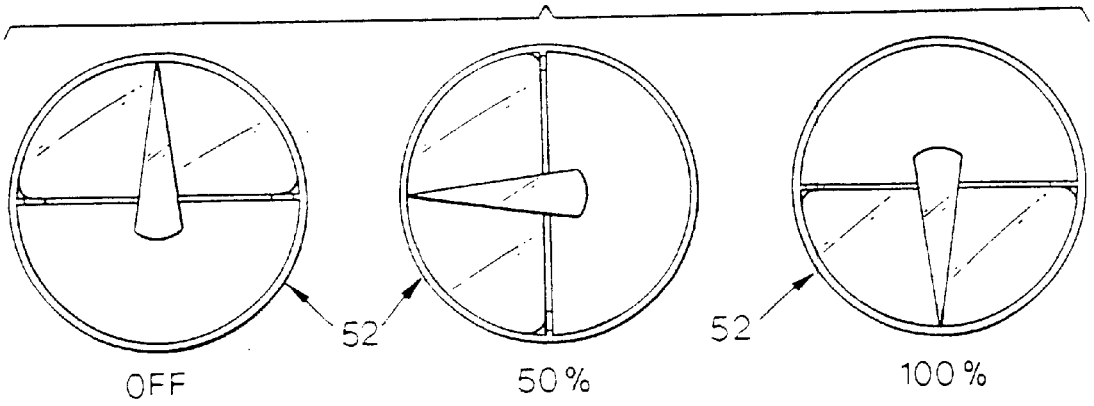

FIG. 9 shows a device 51 having a snap in reservoir 52 with a semi-permeable membrane portion 53 and a chamber portion 54 separated by a wick. Flow control is achieved by rotating the reservoir in device 51.

Figure 10:
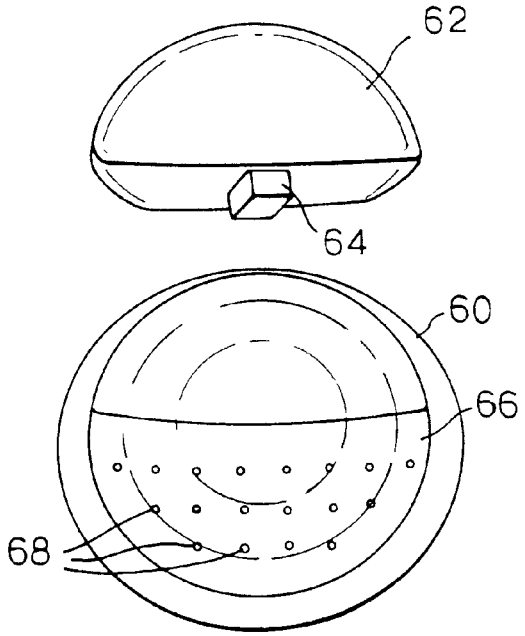
FIG. 10 is a schematic diagram of a tenth device according to the invention.

FIG. 10 illustrates an exploded view of a further device in accordance with the invention. The device comprises a holder 60 which is secured to the door of a tumble drier by an attachment means (not shown) e.g. adhesive pad, suction pad etc. A reservoir 62 has an outlet 64 and is shaped to engage within the body 60. Fabric freshening composition from the reservoir passes to a compartment 66 in the lower half of the body 60. The compartment 66 has an outer wall comprising a plurality of capillary holes 68 through which the fabric freshening composition passes thereby being exposed to airflow and contact with fabric within the tumble drier. The device may be constructed of transparent plastics material so that the contents may be readily viewed and the reservoir replaced or replenished when the device is empty.

In a further embodiment of the invention (not shown) the capillary holes in the wall of the compartment 66 are replaced by a sintered material allowing fabric freshener to pass therethrough.

Figure 11:
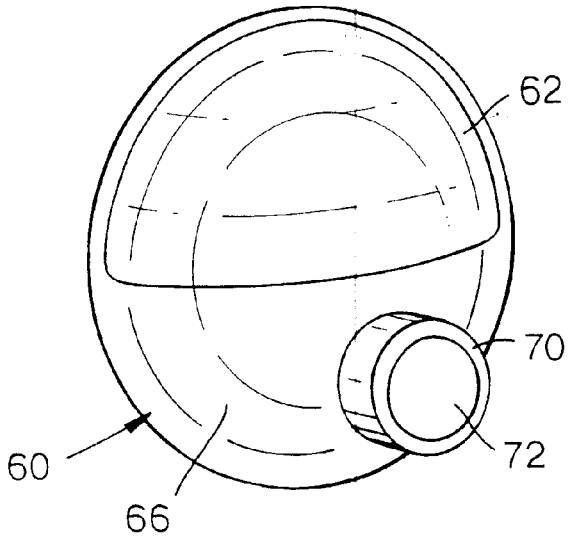
FIG. 11 is a schematic diagram of an eleventh device according to the invention.

The device illustrated in FIG. 11 is similar to the device of FIG. 10 with the exception that the capillary holes are replaced by an outlet 70 having a retained, rotatable sphere 72. Fabric freshener composition passes from the reservoir 62 in to the compartment 66 where it contacts the surface of the sphere 72. Rotation of the sphere 72 by vibration or contact with tumbling garments exposes fabric freshening composition to the airflow generated in the tumble drier.

Figure 12A:
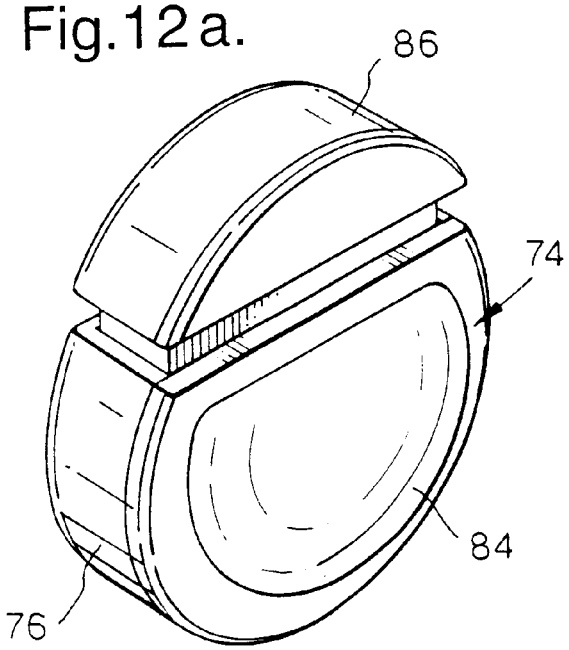
FIG. 12 is a schematic diagram of a twelfth device according to the invention.
Figure 12B:
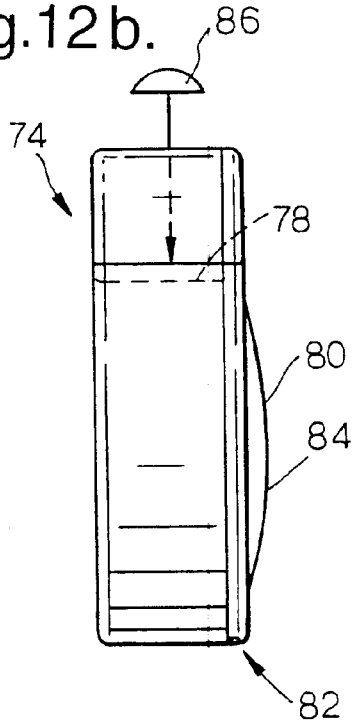

FIG. 12 illustrates a device 74 comprising a reservoir 76 containing fabric freshening composition 78 and a dispensing compartment separate from the reservoir 76 but in communication therewith via a constriction or non-return valve 82. The dispensing compartment 80 has an outer wall comprising a semi-permeable membrane 84. The reservoir is provided with a pump 86 shown schematically. In operation, the pump 86 is operated by pressing downwardly causing fabric freshening composition 78 from the reservoir 76 to pass through the non-return valve 82 in to the dispensing compartment 80. The fabric freshening composition passes slowly through the membrane 84 and is exposed to airflow within the tumble drier. The membrane 84 is flexible and will bulge to a dome shape when fabric freshening composition is pumped in to the compartment 80.

Figure 13A:
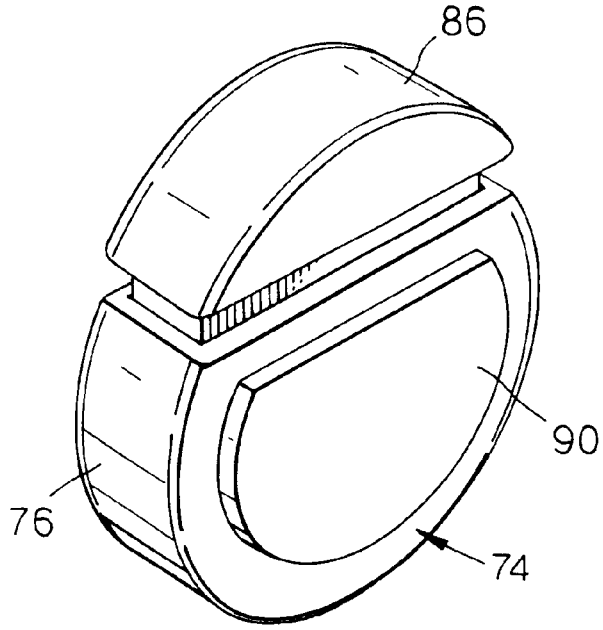
FIG. 13 is a schematic diagram of a thirteenth device according to the invention.
Figure 13B:
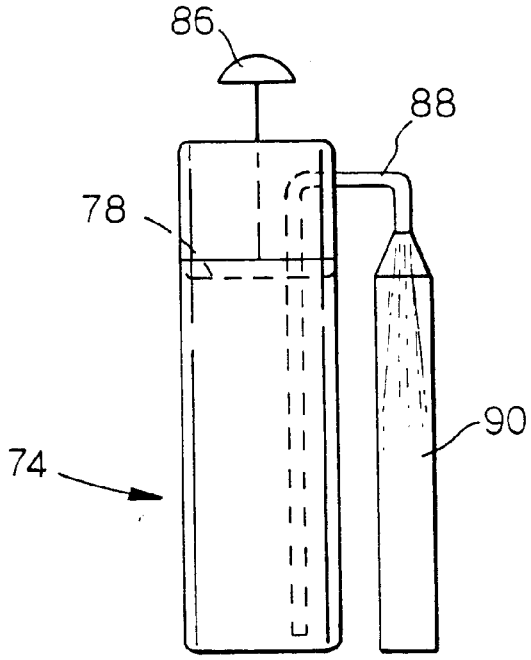
Figure 14A:
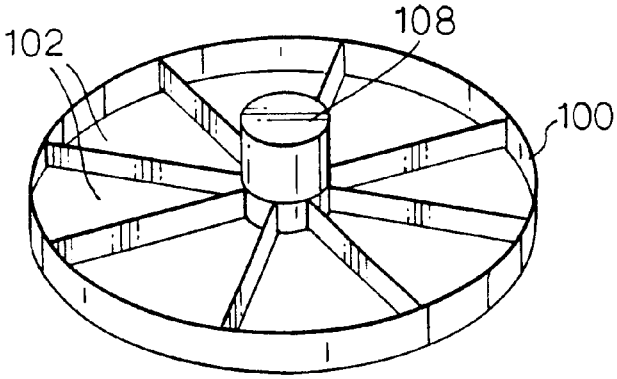
FIG. 14 is a schematic diagram of a fourteenth device according to the invention.
Figure 14B:
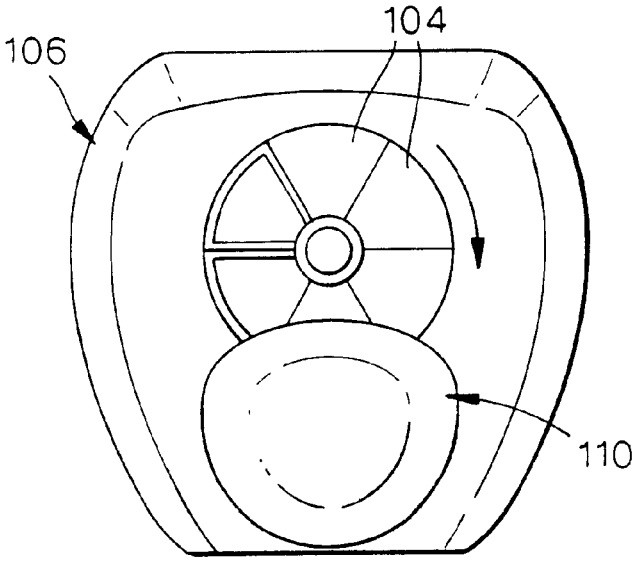
Figure 14C:
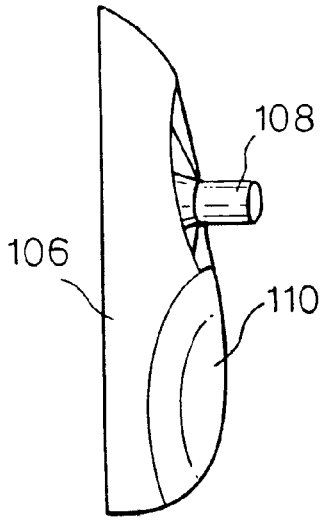
Figure 14D:
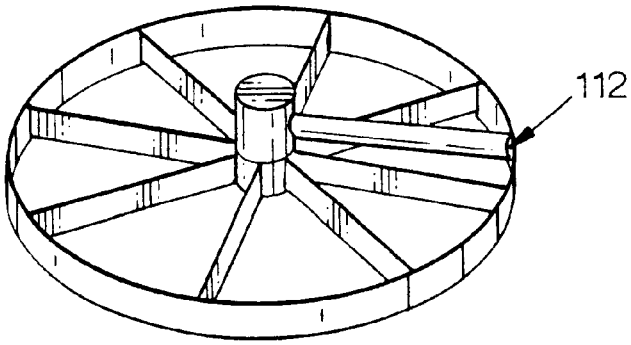

FIG. 13 illustrates a device in accordance with the invention similar to that exposed in FIG. 12 and like parts are shown with like reference numerals. In the device of FIG. 13 the fabric freshening composition 78 is pumped from the reservoir 76 via a conduit 88 to a sponge or foam pad 90. The pad 90 is saturated with fabric freshening composition thereby exposing the composition to airflow generated in the tumble drier.

FIG. 14 illustrates a device in which the reservoir 100 comprises a plurality of compartments 102. The device illustrated has six components but the number may be readily altered. Each compartment 102 contains fabric freshening composition and each compartment is sealed with a lid e.g. film or metal foil 104. The reservoir is rotatably mounted in the body 106 of the device and has a protruding knob 108 to allow manual rotation thereof. The device has a sponge 110 to which each of the compartments 102 may be exposed upon rotation of the reservoir.

In use the reservoir is rotated causing a compartment 102 to become exposed to the sponge pad 110. Exposure may be achieved by the lid of a compartment being rolled back as shown generally at 112 or the lid may be punctured thereby allowing fabric freshener in the compartment 102 to come into contact with the sponge pad 110. The fabric freshener saturates the sponge pad 110 and becomes exposed to airflow generated within the tumble drier. When the fabric freshener from one compartment has been used the reservoir is rotated to expose the next compartment 102 to the sponge pad 110.

What is claimed is:

1. A device for freshening fabrics in a tumble dryer during multiple tumble drying cycles comprising: a reservoir for storing a fabric freshening composition having at least a perfume component, means to expose fabric freshening composition from the reservoir to airflow generated inside the tumble drier thereby transferring a portion of the fabric freshening component into contact with fabrics in the tumble dryer during a tumble drying cycle and means for attaching the device to the inside of the tumble dryer door;

wherein the reservoir is of flexible material and the device comprises means for urging the fabric freshening composition inside the reservoir towards means to expose the fabric freshening composition;

wherein said means to urge comprises a pump;

wherein a non-return valve is disposed between the pump and means to expose fabric freshening composition.

2. A device for freshening fabrics in a tumble dryer during multiple tumble drying cycles comprising: a reservoir for storing a fabric freshening composition having at least a perfume component, means to expose fabric freshening composition from the reservoir to airflow generated inside the tumble drier thereby transferring a portion of the fabric freshening component into contact with fabrics in the tumble dryer during a tumble drying cycle and means for attaching the device to the inside of the tumble dryer door;

wherein the means to expose fabric freshening composition to airflow comprises at least one opening in the reservoir disposed in use to allow fabric freshening composition inside the reservoir to migrate through the at least one opening and subsequently contact air flowing against the external surfaces of the reservoir;

wherein the means to expose fabric freshening composition to airflow comprises at least one opening in the reservoir which is substantially closed by a retained, rotatable sphere whereby fabric freshening composition from the reservoir contacts the surface of the sphere which may rotate to expose fabric freshening composition to airflow generated inside the tumble drier.

* * * * *